US012753532B2

(12) United States Patent
Wang et al.

(10) Patent No.: US 12,753,532 B2
(45) Date of Patent: Oct. 6, 2026

(54) POLYTETRAFLUOROETHYLENE POROUS FIBER AND MANUFACTURING AND MODIFYING PROCESS THEREOF

(71) Applicant: SHANDONG UNIVERSITY, Jinan (CN)

(72) Inventors: Guilong Wang, Jinan (CN); Jialong Chai, Jinan (CN)

(73) Assignee: SHANDONG UNIVERSITY, Shandong (CN)

( * ) Notice: Subject to any disclaimer, the term of this patent is extended or adjusted under 35 U.S.C. 154(b) by 284 days.

(21) Appl. No.: 18/422,618

(22) Filed: Jan. 25, 2024

(65) Prior Publication Data

US 2024/0318358 A1 Sep. 26, 2024

(30) Foreign Application Priority Data

Mar. 24, 2023 (CN) ..... 202310315789.9

(51) Int. Cl.
*D01F 6/12* (2006.01)
*D01D 5/08* (2006.01)
*D01F 11/06* (2006.01)

(52) U.S. Cl.
CPC ..... *D01F 6/12* (2013.01); *D01D 5/08* (2013.01); *D01F 11/06* (2013.01); *D10B 2321/042* (2013.01); *D10B 2401/10* (2013.01)

(58) Field of Classification Search
CPC ... D01F 6/12; D01F 11/06; D01F 1/10; D01D 5/08; D01D 5/247
See application file for complete search history.

(56) References Cited

U.S. PATENT DOCUMENTS 4,360,488 A * 11/1982 Barham ..... C08F 6/12 528/502 B
4,598,011 A * 7/1986 Bowman ..... B29C 55/005 428/221
6,187,238 B1 * 2/2001 Klatt ..... D01F 6/12 264/41

(Continued)

FOREIGN PATENT DOCUMENTS

WO WO-9308321 A1 * 4/1993 ..... D01F 6/12
WO WO-9911706 A2 * 3/1999 ..... C08L 27/12

(Continued)

*Primary Examiner* — Tajash D Patel
(74) *Attorney, Agent, or Firm* — Oliff PLC

(57) ABSTRACT

A polytetrafluoroethylene porous fiber and a manufacturing and modifying process thereof including: blending a PTFE raw material, a processing aid, a modifying filler and the like with certain shear strength by using a blending device; extruding the blend through a die head, drawing, and feeding the blend into a spinning roller for stretching and spinning; feeding the stretched blend fiber into a solvent pool for washing and etching or high-temperature ablation; and drying, annealing and other treatments of the obtained PTFE porous fiber before collection. According to the process, continuous manufacturing of the PTFE fiber with the micro-nano porous structure is achieved, and in-situ modification is conducted on the fiber to avoid complex post-treatment steps. The process is flexible, the production is efficient and low-cost, and the product has adjustable fineness and length, lower density and good air permeability.

8 Claims, 2 Drawing Sheets

(56) References Cited

U.S. PATENT DOCUMENTS

| | | | | |
|---|---|---|---|---|
| 7,160,623 | B2 * | 1/2007 | Smith | C08F 214/262<br>428/421 |
| 8,728,372 | B2 * | 5/2014 | Humphrey | B29C 55/005<br>264/211.13 |
| 2002/0079610 | A1 * | 6/2002 | Uy | D01F 6/32<br>425/464 |

FOREIGN PATENT DOCUMENTS

| | | | | |
|---|---|---|---|---|
| WO | WO-0044967 | A1 * | 8/2000 | D01D 4/00 |
| WO | WO-2012092315 | A2 * | 7/2012 | D01F 6/62 |

* cited by examiner

POLYTETRAFLUOROETHYLENE POROUS FIBER AND MANUFACTURING AND MODIFYING PROCESS THEREOF

TECHNICAL FIELD

The present invention relates to the field of fiber technology, and particularly to a polytetrafluoroethylene porous fiber and a manufacturing and modifying process thereof.

BACKGROUND

Information disclosed in the background section is merely for the purpose of facilitating the understanding of the general background of the present invention and is not necessarily to be taken as an acknowledgment or any form of suggestion that the information constitutes prior art that is already known to those of ordinary skill in the art.

Protective fabrics made of polytetrafluoroethylene (PTFE) fibers have found wide use in some extreme environments in aerospace, chemical industry, machinery, outdoor mapping and other fields. However, there are many difficulties in the manufacturing of PTFE fibers. The PTFE melt has a very high viscosity, and is difficult to flow, so PTFE fibers are difficult to be manufactured by the traditional melt spinning process. Further, PTFE is insoluble in any solvent, and thus the solution spinning process is also difficult to use. Currently, the PTFE manufacturing methods used in industry mainly include emulsion spinning, paste extrusion and split film process. Emulsion spinning includes mixing a PTFE emulsion with an aid and then sintering at a high temperature. However, the structural defects and carbide residues caused by sintering lead to low fiber strength. Furthermore, paste extrusion includes mixing a PTFE powder with an aid into a paste, extruding, and making fibers by using a needle roller, so as to produce PTFE fiber with a higher strength. However, the fineness is larger. The split film process includes sintering a PTFE powder, cutting, and thermally stretching. The strength of the resulting fiber is low.

The improvement of technical requirements for protective fabrics puts forward higher requirements for various performances of fiber materials, such as lower density, higher strength and more functional applications. The construction of micro-nano porous structures inside the fiber can significantly reduce the fiber density and improve the air permeability and heat insulation performance. However, it is difficult to produce PTFE fibers with porous structures by the above-mentioned various manufacturing processes. During paste extrusion, stretching to make holes is a common method to produce PTFE fibers with porous structures. However, high porosity requires high tensile elongation, which will reduce the strength of the fiber. This process is often used to produce flexible fibers for use as carriers in catalysts for exhaust gas decomposition, but less use in the production of textile fabrics. Another method for constructing a porous structure is to add a pore-forming agent in the fiber manufacturing process, and then remove the pore-forming agent by etching to realize pore-forming. However, the high porosity requires the addition of a large amount of pore-forming agents, which in turn leads to frequent filament breakage in the PTFE spinning process, affecting the production efficiency. Furthermore, by using the electrostatic spinning technology, a PTFE emulsion is mixed with an aid such as polyvinyl alcohol to form a jet flow in a high-voltage electric field, with which porous PTFE fiber can be prepared by using a special collection device. However, filaments are hard to continuously produce by using the electrostatic spinning technology, and the production efficiency is not high, which is still far from the requirement for large-scale industrial production.

SUMMARY

To overcome the shortcomings in the prior art, the present invention provides a PTFE porous fiber and a manufacturing and modifying process thereof. In this process, a PTFE raw material and a processing aid are directly blended by a blending device, and PTFE crystals are fibrillated to form an intertwined nanofiber network under the strong shear strength during blending. Then, the blend is extruded through a die head, and stretched and drawn into fibers by a spinning device. Finally, the processing aid is removed from the obtained blend fiber by washing and etching with a solvent or high-temperature ablation, to obtain a PTFE porous fiber with nano-microfiber network structure inside. This method has unique advantages in many aspects: 1. A PTFE fiber with nano-porous structure can be efficiently produced by continuous blending, spinning, and etching/ablation merely using conventional extrusion and spinning devices. The method is applicable to large-scale industrial production. 2. The manufactured PTFE porous fiber has good flexibility, high porosity, low density, high strength, and easily adjustable fineness and length. 3. The PTFE porous fiber can be modified or colored in situ by directly adding a modifying filler or color masterbatch during the blending process, thus giving specific functional properties to the PTFE porous fiber.

To achieve the above object, the following technical solutions are adopted in the present invention.

The present invention provides a process for manufacturing and modifying a PTFE fiber with micro-nano-porous structure by blending and extruding a PTFE raw material, a processing aid, and a modifier, spinning into fibers, and then removing the aid through etching/ablation. Specifically, the PTFE raw material, the processing aid, and the modifier are added to the blending device, and PTFE is fibrillated by strong shearing force during the blending process to form a nano-scale and intertwined nanofiber network structure. After extrusion, the blend product is stretched and spun to make continuous filaments, and the processing aid in the filament is removed by washing and etching with a solvent or high-temperature ablation, while the PTFE nanofiber structure is retained, and the modifying filler is filled in the pores. After high temperature drying and annealing, the fiber is collected.

Further, a process for manufacturing and modifying a PTFE porous fiber includes the following steps:

1) presetting a blending device to a certain temperature, feeding the materials through a feeding port, blending, and controlling the melt temperature and the melt pressure to adjust the degree of PTFE fibrillation;
2) extruding the blend melt through a die head, drawing and stretching the blend melt into continuous filaments by a spinning apparatus, and adjusting the fiber size by adjusting the specifications of the extrusion die, the spinning speed and the temperature and other parameters;
3) removing the processing aid from the fiber, by feeding the stretched blend fiber into a solvent pool for removal by washing and etching or into a high-temperature oven for removal by high-temperature ablation; and
4) drying, annealing, and other treatments of the obtained PTFE porous fiber before collection, where the materials comprise a PTFE raw material and a processing aid.

In a preferred embodiment, the processing aid in Step 1) is a polymer that is flowable at a certain temperature, and such as polyethylene, polypropylene, polybutene, polyvinyl chloride, polyvinylidene fluoride polystyrene, a polyolefin elastomer, polylactic acid, polycaprolactone, polymethyl methacrylate, polyethylene terephthalate, polybutylene terephthalate, polybutylene succinate, a polyaryl ester, polyurethane, polycaprolactam, poly(hexamethylenediamine adipic anhydride), polyphenylene sulfide, polysulfone, polyethersulfone, and other alkene polymers, an amide, an ether, an ester, and a sulfone polymer, paraffin, naphtha, kerosene, and other alkane aids. Further, the amount of the processing aid is 50-95%.

In a preferred embodiment, in Step 1), the PTFE used is a powder or emulsion. To ensure the good fibrillation of PTFE, the molecular weight of PTFE is more than 1,000,000. To avoid PTFE agglomeration and improve the dispersibility, the PTFE surface can be modified by coating with PMMA, PS, and SAN, etc. Further, the amount of PTFE is 5-50%.

In a preferred embodiment, in Step 1), the blending device used is a single-screw, twin-screw extruder, or combined-screw extruder, and the blending temperature is higher than the melting temperature of the processing aid, so that the processing aid is in a flowing state and has a certain viscosity and strength, so as to ensure that the shearing force is transferred to PTFE crystals during the blending process.

In a preferred embodiment, in Step 1), a modifying filler can be added during the melting and blending as needed to impart the PTFE porous fiber with corresponding functional properties. For example, carbon black, color masterbatch particles, a dye, a dye-fixing agent and the like can be added to color the PTFE porous fiber. A talc powder, a softener, an antistatic agent and others can be added to improve the flexibility of the PTFE porous fiber. Lubricants such as paraffin, vegetable oil and polyethylene glycol can be added to improve the porosity and pore size of the PTFE porous fiber. Polyether ether ketone, polyimide, polyetherimide and other reinforcing phases can be added to improve the strength and toughness of the PTFE porous fiber. Conductive fillers such as carbon nanotubes, carbon nanofibers, graphene a metal powder and Mxene can be added to adjust the conductivity of the PTFE porous fiber. Thermally conductive fillers such as boron nitride, silicon carbide, and aluminum oxide can be added to enhance the thermal conductivity of the PTFE porous fiber. Fillers such as silver nanofibers, silver powder and zinc oxide can also be added to give the PTFE porous fiber excellent antibacterial performance. Further, the amount of the modifying filler is 1-50% of the total weight of the final PTFE porous fiber.

In a preferred embodiment, in Step 2), the shape and size of the extrusion die can be adjusted as required, the diameter of the extruded blend fiber is 0.5-5 mm, and the diameter of the PTFE porous fiber after removing the processing aid is 0.02-2 mm.

In a preferred embodiment, in Step 2), the stretching fiber-making device is a spinning roller equipped with a heating device, the spinning temperature is between 50 and 320° C., and the specific temperature can be determined according to the properties of the processing aid. The spinning speed can be adjusted according to the required fiber diameter.

In a preferred embodiment, in Step 3), according to the nature of the processing aid, the processing aid can be removed by washing and etching with a solvent. A polar or non-polar solvent can be used for etching, such as water, toluene, xylene, methanol, ethanol, isopropanol, diethyl ether, ethylene oxide, methyl acetate, ethyl acetate, dichloromethane chloroform, perchlorocarbon, acetone, methyl butanone, ethylene glycol monomethyl ether, cyclohexane, cyclohexanone, acetonitrile, pyridine, phenol, N,N-dimethylformamide, dimethyl sulfoxide, carbon tetrachloride and mixtures thereof, The washing temperature with the solvent is 25-100° C., and the time is 1-12 hrs, which can be determined according to the solubility of the processing aid in the solvent. The solvent can be recycled by distillation and other means, to reduce the solvent consumption. The processing aid can also be removed by a high-temperature ablation process. The ablation temperature should be higher than the evaporation, sublimation or decomposition temperature of the processing aid, and the ablation time is 30-180 min. Further, the high-temperature ablation and solvent etching can be used in combination to remove the aid and reduce the residual amount of the processing aid in the fiber.

In a preferred embodiment, in Step 4), the solvent in the fiber from which the processing aid is removed is dried with a blower or a high-temperature oven. Further, the obtained PTFE fiber can be annealed at a high temperature. The annealing temperature is higher than the processing temperature and lower than the melting temperature of PTFE, and the annealing time is 5-120 min. During annealing, a clamp is used to keep the fiber in its basic shape, so as to avoid the shrinkage at high temperature.

In a preferred embodiment, in Step 4), the fiber can be twisted to improve the elasticity and toughness of the fiber and improve its appearance and quality.

In a preferred embodiment, in Step 4), the obtained PTFE porous fiber is collected by a collecting roller.

Compared with related art, the present invention has the following beneficial effects.

1) A PTFE fiber with a porous structure is directly produced through a series of continuous processes such as blending, extrusion, stretching, etching, drying and annealing. The process is simple and efficient, with which continuous and efficient production can be realized.
2) The obtained PTFE porous fiber is continuous and uniform, has a nanofiber structure inside, high porosity and excellent heat insulation performance. The fiber is resistant to acid, alkaline, and organic solvents, and has excellent mechanical performances.
3) A variety of modifiers can be added according to actual needs to realize in-situ modification during processing, and directly processed into fibers, thus avoiding complicated subsequent modification procedures.

BRIEF DESCRIPTION OF THE DRAWINGS

The accompanying drawings consisting a part of the present invention are intended to provide further understanding of the present invention and the schematic embodiments and description thereof in the present invention are provided for explaining the present invention, and do not constitute a restriction on the present invention.

DETAILED DESCRIPTION

It should be noted that the following detailed description is exemplary and is intended to provide a further description of the present invention. Unless otherwise indicated, all technical and scientific terms used herein have the same meaning as commonly understood by one of ordinary skill in the art to which the present invention belongs.

As introduced in the technical background, the PTFE porous fiber has the disadvantages of difficult processing, poor strength and high manufacturing cost. The present invention provides a method for preparing a PTFE porous fiber through a series of continuous processes such as blending, extrusion, stretching into fibers, solvent etching, drying, annealing and so on.

Example 1

Figure 1:
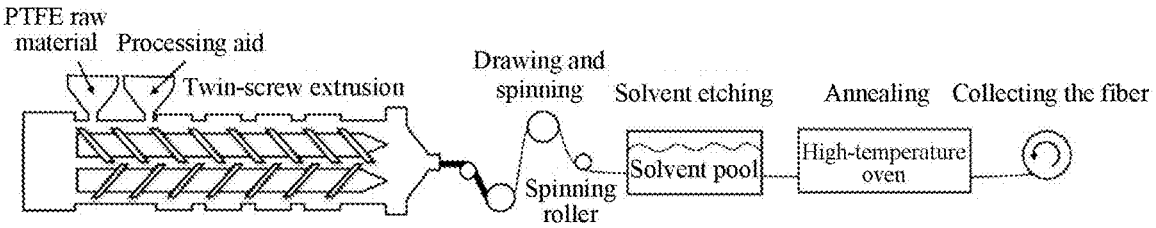
FIG. 1 is a flow chart of a process for manufacturing and modifying a PTFE porous fiber provided in the present invention.

A PTFE powder is used as a raw material, polylactic acid (PLA) is used as a processing aid, and dichloromethane is used as a washing and etching solvent. For example, a PTFE porous fiber was prepared by the present process (as shown in FIG. 1), in which the raw materials include PLA particles produced by Natureworks, and PTFE powder produced by Daikin. The PLA and PTFE raw material particles are dried before the experiment. The blending device is a twin-screw extruder, the drawing device is a spinning roller driven by a variable frequency motor, the washing and etching device is a solvent pool, and the drying device is a high-temperature oven.

- Step I: The twin-screw extruder was heated to 180° C., the PTFE powder and PLA particles at a weight ratio of 3:7 were fed through a feeding port, and the screw was started to rotate where the screw speed was adjusted to 50 rpm and the pressure was controlled to 18 MPa.
- Step II: The blend was extruded through a die hole with a diameter of 3, 2, 1.5, and 1 mm, drawn to a spinning roller for spinning. The temperature of the spinning roller was set to 140° C., and the rotational speed ratio is set to 1:2. The obtained blend fiber has a diameter of 0.8, 0.6, 0.3, and 0.2 mm.
- Step III: The blend fiber was drawn into a solvent pool for washing and etching with a solvent. The etching time was 2 hrs, and the procedure was repeated 3 times.
- Step IV: The washed and etched PTFE porous fiber was dried, and collected by a collecting roller. The PTFE porous fiber was naturally cooled.

Figure 2:
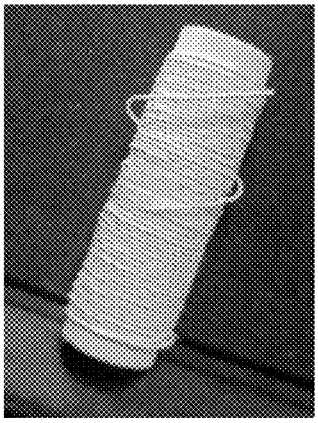
FIG. 2 is a photo of a PTFE porous fiber sample prepared by the process of the present invention in Example 1.
Figure 3:
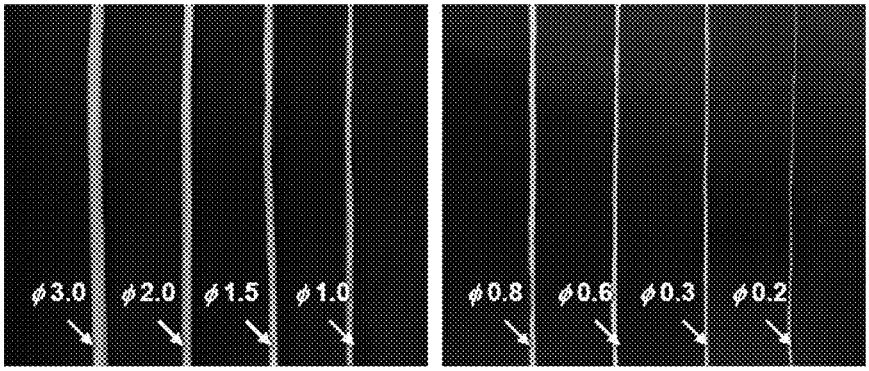
FIG. 3 shows PTFE porous fibers of various diameters prepared by the process of the present invention in Example 1.
Figure 4:
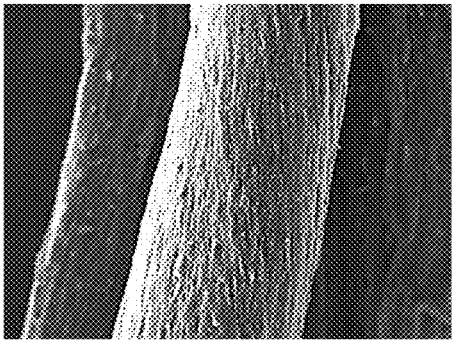
FIG. 4 is an electron microscopy image showing the microstructure of PTFE porous fiber prepared by the process of the present invention in Example 1.
Figure 5:
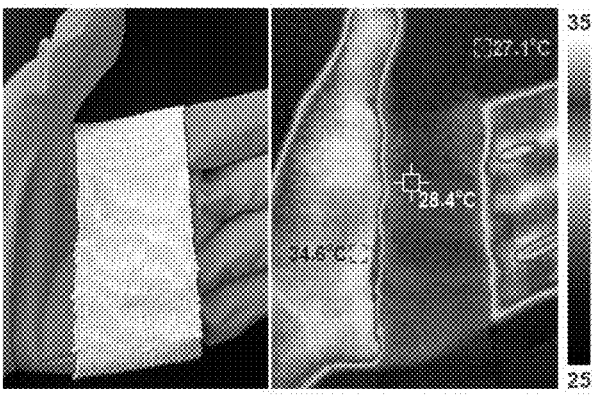
FIG. 5 shows a fabric woven with PTFE porous fiber prepared by the process of the present invention in Example 1 and its heat insulation performance test.

In this example, the PTFE porous fiber obtained is as shown in FIG. 2. The fiber has smooth surface and good continuity and uniformity. The fiber diameter is shown in FIG. 3, and the fineness can be flexibly adjusted. The microstructure is shown in FIG. 4, and is essentially composed of oriented PTFE nanofibers with a large number of pores therebetween. The fiber density is determined to be about 0.6 g/cm$^3$, the tensile strength is 40 MPa, and the elongation at break is more than 60%. The fabric woven with the PTFE porous fiber has good heat insulation performance, as shown in FIG. 5.

Example 2

A PTFE powder is used as a raw material, polymethyl methacrylate (PMMA) is used as a processing aid, multi-walled carbon nanotubes (MWCNTs) are used as a conductive filler and N,N-dimethylformamide (DMF) is used as an etching solvent. For example, an electrically conductive PTFE porous fiber was prepared by the present process, in which the raw materials include PMMA particles produced by Chi Mei Corporation, PTFE powder produced by Mitsubishi Chemical, and MWCNT powder produced by Chinese Academy of Sciences. All the raw materials are dried before the experiment. The blending device is a twin-screw extruder, the drawing device is a spinning roller driven by a variable frequency motor, and the annealing device is a high-temperature oven.

- Step I: MWCNT and PMMA at a weight ratio of 1:10 were dissolved in DMF, to form a uniform solution. The solution was dried, to obtain PMMA/MWCNT masterbatch. This ensured the uniform dispersion of MWCNT.
- Step II: The twin-screw extruder was heated to 200° C., PMMA particles, PMMA/MWCNT masterbatch, and PTFE powder at a weight ratio of 5:5:2 were fed through a feeding port, and the screw was started to rotate where the screw speed was adjusted to 30 rpm and the pressure was controlled to 13 MPa.
- Step II: The blend was extruded through a die hole with a diameter of 2 mm, and drawn to a spinning roller for spinning. The temperature of the spinning roller was set to 140° C., and the rotational speed ratio is set to 1:4. The obtained blend fiber has a diameter of 1 mm.
- Step III: The blend fiber was drawn into a solvent pool containing a large amount of DMF for washing and etching with a solvent. The etching time was 2 hrs, and the procedure was repeated 3 times.
- Step IV: The etched electrically conductive PTFE porous fiber was dried, and collected by a collecting roller. The fiber was kept in a tightened state, dried in a high-temperature oven, annealed and shaped. The annealing temperature was 340° C., and the time was 10 min. After annealing, the electrically conductive PTFE porous fiber was naturally cooled.

Figure 6:
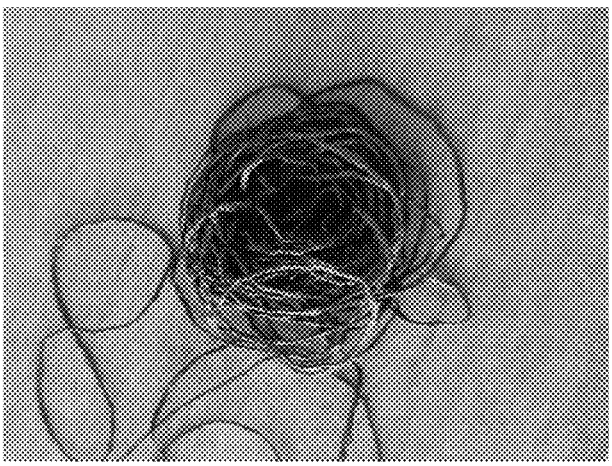
FIG. 6 is a photo of an electrically conductively modified PTFE porous fiber sample prepared by the process of the present invention in Example 2.
Figure 7:
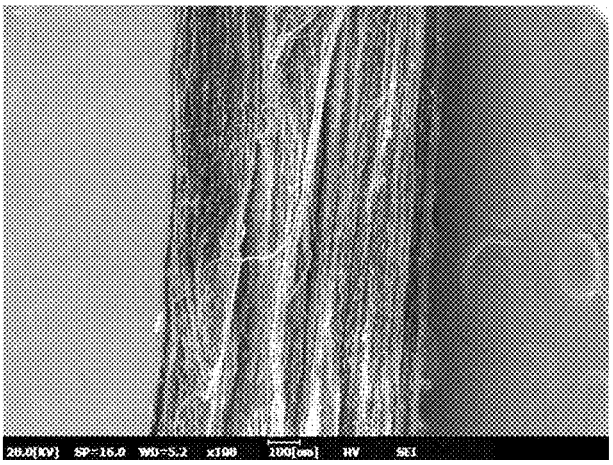
FIG. 7 is an electron microscopy image showing the microstructure of the electrically conductively modified PTFE porous fiber prepared by the process of the present invention in Example 2.

In this example, the obtained electrically conductive PTFE porous fiber is as shown in FIG. 6. The fiber has a black surface and good continuity and uniformity. The microstructure is shown in FIG. 7. The fiber has a diameter of about 500 microns, and is essentially composed of PTFE microfibers with a large number of pores therebetween, and MWCNT is distributed in the pores. The fiber density is determined to be about 0.68 g/cm$^3$, the tensile strength is 35 MPa, and the elongation at break is more than 60%. The fabric woven with the electrically conductive PTFE porous fiber has good conductive performance, with a conductivity of about 103 S/m.

Preferred embodiments of the present invention have been described above; however, the present invention is not limited thereto. Various variations and changes can be made by those skilled in the art to the present invention. Any modification, equivalent substitution, and improvement made without departing from the spirit and principle of the present invention are intended to be included within the scope of the present invention.

What is claimed is:

1. A process for manufacturing and modifying a PTFE porous fiber, comprising the following steps:

1) presetting a blending device to a certain temperature, feeding the materials through a feeding port, blending, and controlling the melt temperature and the melt pressure to adjust the degree of PTFE fibrillation; *p1

2) extruding the blend melt through a die head, drawing and stretching the blend melt into continuous filaments by a spinning apparatus, and adjusting the fiber size by adjusting the specifications of the extrusion die, the spinning speed and the temperature;

3) removing the processing aid from the fiber, by feeding the stretched blend fiber into a solvent pool for removal by washing and etching or into a high-temperature oven for removal by high-temperature ablation; and 4) drying, and annealing the obtained PTFE porous fiber before collection, wherein the materials comprise a PTFE raw material and a processing aid; and wherein, in step 1), a modifying filler is added and blended, wherein the modifying filler is directly added during melt blending to realize in-situ modification, and wherein the modifying filler comprises one or more of a coloring agent, a flexibility modifying agent, a lubricant, a reinforcing agent, a conductive agent, a thermally conductive filler, and an antibacterial agent, in which the coloring agent comprises one or more of carbon black, color masterbatch particles, a dye, and a dye-fixing agent; the flexibility modifying agent comprises one or more of talc powder, a softener, and an anti-static agent; the lubricant comprises one or more of paraffin, vegetable oil, and polyethylene glycol; the reinforcing agent comprises one or more of polyether ether ketone, polyimide, and polyetherimide; the conductive agent comprises one or more of carbon nanotubes, carbon nanofibers, graphene, a metal powder, and Mxene; the antibacterial agent comprises one or more of silver nanofibers, silver powder, and zinc oxide; and the amount of the modifying filler is 1-50% of the total weight of the fiber.

2. The manufacturing and modifying process according to claim 1, wherein the stretching fiber-making device is a spinning roller equipped with a heating device, the drawing and spinning temperature is adjusted between 50-320° C. according to the nature of the processing aid, the fiber diameter is adjusted by adjusting the spinning speed, the diameter of the stretched blend fiber is 0.5-5 mm, and the diameter of the PTFE porous fiber after removing the processing aid is 0.02-2 mm.

3. The manufacturing and modifying process according to claim 1, wherein during the etching process, the processing aid is removed by washing and etching with a solvent according to the nature of the processing aid, where a polar or non-polar solvent is used for etching, and the solvent is one or more selected from water, toluene, xylene, methanol, ethanol, isopropanol, diethyl ether, ethylene oxide, methyl acetate, ethyl acetate, dichloromethane chloroform, perchlorocarbon, acetone, and methyl butanone, ethylene glycol monomethyl ether, cyclohexane, cyclohexanone, acetonitrile, pyridine, phenol, N,N-dimethylformamide, dimethyl sulfoxide, and carbon tetrachloride; the washing temperature with the solvent is 25-100° C., and the time is 1-12 hrs, which are determined according to the solubility of the processing aid in the solvent; the solvent is recycled by distillation, or the processing aid is removed by a high-temperature ablation process, where the ablation temperature is higher than the evaporation, sublimation and decomposition temperature of the processing aid, and the ablation time is 30-180 min, to reduce the residual amount of the processing aid in the fiber.

4. The manufacturing and modifying process according to claim 1, wherein the solvent in the fiber from which the processing aid is removed is dried with a blower or a high-temperature oven; and high-temperature annealing is carried out for 5-120 min at a temperature that is higher than the processing temperature and lower than the melting temperature of PTFE, and during the annealing, a clamp is used to keep the fiber in basic shape, so as to avoid the shrinkage at high temperature, or the fiber is twisted to improve the elasticity and toughness of the fiber and improve its appearance and quality.

5. A PTFE porous fiber obtained by the manufacturing and modifying process according to claim 1.

6. A PTFE porous fiber obtained by the manufacturing and modifying process according to claim 2.

7. A PTFE porous fiber obtained by the manufacturing and modifying process according to claim 3.

8. A PTFE porous fiber obtained by the manufacturing and modifying process according to claim 4.

* * * * *